US006899149B1

(12) United States Patent
Hartsell, Jr. et al.

(10) Patent No.: US 6,899,149 B1
(45) Date of Patent: May 31, 2005

(54) VAPOR RECOVERY FUEL DISPENSER FOR MULTIPLE HOSES

(75) Inventors: Hal C. Hartsell, Jr., Kernersville, NC (US); Kenneth L. Pope, Walkertown, NC (US)

(73) Assignee: Gilbarco Inc., Greensboro, NC (US)

( * ) Notice: Subject to any disclaimer, the term of this patent is extended or adjusted under 35 U.S.C. 154(b) by 1214 days.

(21) Appl. No.: 08/033,311

(22) Filed: Mar. 15, 1993

Related U.S. Application Data

(63) Continuation-in-part of application No. 07/946,741, filed on Sep. 16, 2002, now Pat. No. 5,955,915, which is a continuation-in-part of application No. 07/824,702, filed on Jan. 21, 1992, now Pat. No. 5,156,199, which is a continuation of application No. 07/625,892, filed on Dec. 11, 1990, now abandoned.

(51) Int. Cl.[7] ..... B65B 1/04

(52) U.S. Cl. ..... 141/192; 141/59

(58) Field of Search ..... 141/1, 4, 5, 44–46, 141/59, 51, 83, 192, 198, 128; 137/587–589; 55/587

(56) References Cited

U.S. PATENT DOCUMENTS

| | | | | |
|---|---|---|---|---|
| 2,401,124 A | 5/1946 | Walker | 226/119 |
| 3,016,928 A | 1/1962 | Brandt | 141/15 |
| 3,605,824 A | 9/1971 | Madden et al. | 141/1 |
| 3,756,291 A | 9/1973 | McGahey et al. | 141/45 |
| 3,791,422 A | 2/1974 | Johnson et al. | 141/1 |
| 3,826,291 A | 7/1974 | Steffens | 141/59 |
| 3,850,208 A | 11/1974 | Hamilton | 141/59 |
| 3,881,894 A | 5/1975 | Onufer | 55/88 |
| 3,899,009 A | 8/1975 | Taylor | 141/59 |
| 3,905,405 A | 9/1975 | Fowler | 141/46 |
| 3,913,633 A | 10/1975 | Hiller | 141/45 |
| 3,915,206 A | 10/1975 | Fowler et al. | 141/59 |
| 3,926,230 A | 12/1975 | Stary et al. | 141/45 |
| 3,941,168 A | 3/1976 | Hiller | 141/46 |
| 3,952,781 A | 4/1976 | Hiller | 141/46 |

(Continued)

FOREIGN PATENT DOCUMENTS

| | | |
|---|---|---|
| DE | 2817980 | 11/1978 |
| DE | 0900719 | 8/1990 |
| DE | 3903603 | 8/1990 |
| FR | 2641267 | 7/1990 |
| GB | 2014544 | 8/1979 |
| GB | 2226812 | 7/1990 |

OTHER PUBLICATIONS

Hirt Combustion Engineers (VCS–200 Vapor Net 6 pgs.)
Gulf (VCP System)—4 pgs.
USSN 036, 302 filed May 7, 1979, cited at column I, lines 36–40 of U.S. Pat. 4,429,725; see p. 7, line 25 through p. 8, line 26.

*Primary Examiner*—Steven O. Douglas
(74) *Attorney, Agent, or Firm*—Withrow & Terranova, PLLC

(57) ABSTRACT

A dispensing system for dispensing volatile liquids such as hydrocarbon fuel for vehicles into a tank having a filler neck also collects the vapors to reduce atmospheric pollution. A fuel delivery hose includes a hand-held fuel valve and nozzle for insertion in the opening of the tank. A means delivers fuel under pressure to the fuel delivery hose, and another means provides electrical pulses corresponding to the volumetric flow of liquid through the fuel delivery hose when the fuel valve is open. A vapor recovery hose includes a vapor intake connected to the hand-held nozzle for insertion in the opening of the tank without sealing with the tank, and a motor driven vapor pump produces a volumetric flow through the vapor recovery hose corresponding to a signal applied to the motor. A processing means produces the signal applied to the motor in response to the electrical pulses to produce a volumetric flow of vapor slightly greater than the volumetric flow of fuel to the tank.

11 Claims, 7 Drawing Sheets

U.S. PATENT DOCUMENTS

| | | | | | |
|---|---|---|---|---|---|
| 3,981,334 | A | | 9/1976 | Deters | 141/46 |
| 4,009,985 | A | | 3/1977 | Hirt | 431/5 |
| 4,020,861 | A | | 5/1977 | Shihabi | 137/100 |
| 4,047,548 | A | | 9/1977 | Wagner | 141/52 |
| 4,056,131 | A | | 11/1977 | Healy | 141/206 |
| 4,057,085 | A | | 11/1977 | Shihabi | 141/59 |
| 4,057,086 | A | | 11/1977 | Healy | 141/206 |
| 4,058,147 | A | | 11/1977 | Stary et al. | 141/45 |
| 4,063,874 | A | | 12/1977 | Stary et al. | |
| 4,068,687 | A | | 1/1978 | Long | 141/59 |
| 4,082,122 | A | | 4/1978 | McGahey | 141/5 |
| 4,095,626 | A | | 6/1978 | Healy | 141/206 |
| 4,118,170 | A | | 10/1978 | Hirt | 431/5 |
| 4,153,073 | A | | 5/1979 | Deters | 137/493 |
| 4,166,485 | A | | 9/1979 | Wokas | 141/52 |
| 4,167,958 | A | | 9/1979 | Voelz | 141/95 |
| 4,197,883 | A | | 4/1980 | Mayer | 141/95 |
| 4,199,012 | A | | 4/1980 | Lasater | 141/52 |
| 4,202,385 | A | | 5/1980 | Voelz | 141/59 |
| 4,223,706 | A | | 9/1980 | McGahey | 141/59 |
| 4,253,503 | A | | 3/1981 | Gunn | 141/59 |
| 4,256,151 | A | | 3/1981 | Gunn | 141/59 |
| 4,260,000 | A | | 4/1981 | McGahey | 141/59 |
| 4,273,164 | A | | 6/1981 | Gunn | 141/7 |
| 4,292,020 | A | | 9/1981 | Hirt | 431/5 |
| 4,295,505 | A | | 10/1981 | Hasselmann | 141/301 |
| 4,306,594 | A | | 12/1981 | Planck | 141/59 |
| 4,310,033 | A | | 1/1982 | Deters | 141/94 |
| 4,336,830 | A | | 6/1982 | Healy | 141/59 |
| 4,429,725 | A | | 2/1984 | Walker | 141/59 |
| 4,649,970 | A | | 3/1987 | Bower | 141/302 |
| 4,680,004 | A | | 7/1987 | Hirt | 431/5 |
| 4,687,033 | A | | 8/1987 | Furrow | 141/59 |
| 4,749,009 | A | | 6/1988 | Faeth | 141/45 |
| 4,790,349 | A | | 12/1988 | Harris | 141/46 X |
| 5,005,613 | A | | 4/1991 | Stanley | 141/45 |
| 5,038,838 | A | * | 8/1991 | Bergamini et al. | 141/59 |
| 5,040,577 | A | * | 8/1991 | Pope | 141/59 |
| 5,123,817 | A | | 6/1992 | Willemson | 417/404 |
| 5,156,199 | A | * | 10/1992 | Hartsell | 141/83 |
| 5,172,738 | A | * | 12/1992 | Komukai | 141/83 |
| 5,195,564 | A | * | 3/1993 | Spalding | 141/1 |
| 5,197,523 | A | * | 3/1993 | Fink, Jr. et al. | 141/206 |

* cited by examiner

VAPOR RECOVERY FUEL DISPENSER FOR MULTIPLE HOSES

RELATED APPLICATIONS

This application is a continuation-in-part of application Ser. No. 07/946,741 filed Sep. 16, 1992, now U.S. Pat. No. 5,955,915 which is a continuation-in-part of application Ser. No. 07/824,702 filed Jan. 21, 1992, (now U.S. Pat. No. 5,156,199 issued Oct. 20, 1992) which is a continuation of application Ser. No. 07/625,892 filed Dec. 11, 1990, now abandoned. The disclosures of application Ser. No. 07/946,741 and U.S. Pat. No. 5,156,199 are hereby incorporated by reference.

FIELD OF THE INVENTION

U.S. patent application entitled "Vapor Recovery System for Fuel Dispenser" filed on May 21, 1990, in the name of Kenneth L. Pope, and bearing Ser. No. 07/526,303 now U.S. Pat. No. 5,040,577.

The field of the present invention relates generally to fuel dispensers, and more particularly to vapor recovery systems for use when dispensing a volatile fuel such as gasoline.

BACKGROUND OF THE INVENTION

Vapor recovery fuel dispensers, particularly gasoline dispensers, have been known for quite some time, and have been mandatory in California for a number of years. The primary purpose of using a vapor recovery fuel dispenser is to retrieve or recover the vapors which would otherwise be emitted to the atmosphere during a fueling operation, particularly for motor vehicles. The vapors of concern are generally those which are contained in the vehicle gas tank. As the liquid gasoline is pumped into the tank, the vapor is displaced and forced out through the filler pipe. Other volatile liquids such as hydrocarbon fluids raise similar issues.

The traditional vapor recovery apparatus is known as the "balance" system, in which a sheath or boot encircles the liquid fueling spout and connects with tubing back to the fuel reservoir. As the liquid enters the tank, the vapor is forced into the sheath and back toward the fuel reservoir where the vapors can be stored or recondensed.

Balance systems have numerous drawbacks, including cumbersomeness, difficulty of use, ineffectiveness when seals are poorly made, and slowed fueling rates.

As a dramatic step to improve on the balance systems, Gilbarco, Inc., assignee of the present invention, patented an improved vapor recovery system for fuel dispensers, U.S. Pat. No. 5,040,577 to Kenneth L Pope. The Pope patent discloses a vapor recovery apparatus in which a vapor pump is introduced in the vapor return line, driven by a motor. The liquid flow line includes a pulser, conventionally used for generating pulses indicative of the amount of liquid fuel being pumped. This permits computation of the total sale and the display of the volume of liquid and the cost in a conventional display, such as, for example as shown in U.S. Pat. No. 4,122,524 to McCrory et al. A microprocessor translates the pulses indicative of the liquid flow rate into a desired vapor pump operating rate. The effect was to permit the vapor to be pumped at a rate correlated with the liquid flow rate so that, as liquid is pumped faster, vapor is also pumped faster.

While the apparatus described in detail in the Pope patent is significant and quite workable, various improvements and refinements have been discovered to further enhance the usability of it and similar vapor recovery systems.

In particular, since the vapor pump is independently driven, in the event of a malfunction so that the vapor pump is operating when the liquid pump is not, there is a possibility of drawing large volumes of air into the liquid storage tank. When the quantity of air reaches a high enough level, the air/vapor mixture in the tank can reach dangerously explosive proportions. Accordingly, safety features are needed to assure that excessive amounts of air are not drawn in.

Further, it has been found that if liquid is pumped back through the vapor pump line in large quantities, damage to the vapor pump can result, so that a need is present to deal with that circumstance.

In dispensing systems for vaporizable liquid, the liquid flows to the tank being filled through a tube and vapor is sucked by a recovery pump from the tank via an adjacent tube. If the temperature of the liquid and the temperature of the vapor in the tank are the same, the volumetric flow $V_R$ of the vapor recovery pump can be made more or less equal to the volumetric flow of the liquid, $V_L$. However, if the temperatures are different, a heat exchange takes place between the liquid and the vapor in the vehicle tank so that the vapor expands or contracts in accordance with the universal gas law PV=mRT. Therefore, in order to evacuate all of the vapor that is displaced from the tank as the liquid enters it and yet not suck in excess air by sucking too hard, the volumetric flow of the vapor recovery pump must be varied. By way of example, if the temperature of the vapor in the tank being filled is colder than the liquid being pumped into it from an underground reservoir, as may well occur during winter, the vapor in the vehicle tank will be heated and will expand, thereby requiring an increase in the volumetric flow of the vapor pump. The opposite effects may take place during the summer. Compensation of the vapor flow rate to account for these differences is needed.

SUMMARY OF THE INVENTION

The present invention fulfills these needs in the art by providing a vapor recovery fuel dispenser for dispensing volatile liquids such as hydrocarbon fuel for vehicles into a tank having a filler neck while collecting the vapors to reduce atmospheric pollution. The dispenser includes at least one liquid dispensing means including a hand-held nozzle and liquid valve means disposed at the end of a flexible hose for flowing liquid into the fuel tank of a vehicle under the control of an operator operating the liquid valve, and it includes a vapor collection means. The vapor collection means includes a vapor intake means manipulated with the hand-held nozzle so as to be positioned closely adjacent, but not sealed with, the fuel tank during delivery of fuel to the tank, a normally closed vapor valve operable when liquid is flowing through the liquid valve of the nozzle, and vapor suction means including a vapor pump driven by an electrical motor and coupled to draw vapor through the vapor intake and the vapor valve and deliver the vapor to vapor storage means. A flow meter produces a first electrical signal representative of the rate of flow of liquid being dispensed from the nozzle, and processing means receives the first electrical signal and operates the electric motor at a controlled rate to draw vapors through the vapor intake at a volumetric rate slightly greater than the volumetric rate at which liquid is being flowed from the nozzle. Thus, substantially all fuel vapor displaced from the tank will be delivered to the vapor storage means while minimizing delivery of air to the vapor storage means. The electrical signal may take the form of electrical pulses at a repetition rate corresponding to the volumetric flow of liquid through the fuel delivery hose when the fuel valve is open.

In a preferred embodiment a different grade of hydrocarbon fuel is dispensed from each of a plurality of nozzle and liquid valve means, and the processing means includes a point of sale display indicating the volume and cost of the fuel dispensed. Most often, there are three grades of fuel dispensed from three nozzle and liquid valve means. Each grade of hydrocarbon fuel may be dispensed from a different storage tank, and vapor within the storage tanks may be in fluid communication, with the collected vapors returned to the storage tanks. A pump may be provided for each of the delivery hoses for providing a flow of fuel of a different grade to their respective nozzles.

The vapor return piping for a dispenser is typically configured so that the hoses operable from one side of the dispenser—usually three in number—have their vapor return hoses manifolded together and connected to a single vapor return pump and motor leading to the underground storage tanks from whence the liquid fuel is pumped. Non-active hoses on the side of a dispenser are closed off through the use of the vapor valves associated with those hoses. These valves may be mechanically actuated or of the electrical solenoid type and may be located either in the dispenser housing or in the nozzle.

Each hand-held nozzle and liquid valve means may include a vapor valve operated in synchronization with and in response to manual operation of the liquid valve means whereby only the vapor intake associated with the nozzle from which liquid is being dispensed will function to collect vapor. Preferably, a hand-operated liquid valve is attached to the nozzle, and the vapor collection means includes a vapor valve between the vapor pump and the end of the nozzle, which is opened only when fuel is being delivered. For example, each vapor valve may be attached to the respective hand-held nozzle and be opened in response to the user causing fuel to be delivered through the nozzle. The vapor pump may be operated in such a manner as to produce a volumetric flow in the respective vapor hose slightly greater than that in the respective fuel delivery hose. Or, the vapor pump may be operated in such a manner as to produce a volumetric flow in the respective vapor hose less than that in the respective fuel delivery hose.

One embodiment includes a liquid fuel pump for pumping liquid fuel from a fuel reservoir along a fuel delivery line to an outlet, a vapor pump for returning fuel vapors from proximate the outlet along a vapor return line to a vapor repository, and a controller operably interposed between the liquid fuel pump and the vapor pump which monitors when both pumps are operating and disables operation of the vapor pump when the liquid pump is not operating.

In a preferred embodiment the signal indicative of operation of the motor is a pulse train and the controller counts pulses in the pulse train during periods when the signal to operate the vapor pump is absent and disables operation of the vapor pump motor when a threshold number of pulses is counted.

In a further aspect, the invention provides a vapor recovery fuel dispenser including a vapor pump for returning fuel vapors from proximate a liquid fuel outlet along a vapor return line to a vapor repository, an electric motor driving the pump, and a controller which monitors the electrical current to the motor and disables operation of the vapor pump motor when the monitored current indicates a system error, such as liquid fuel blocking the vapor return line.

In an alternate embodiment, the invention provides a vapor recovery fuel dispenser system including a liquid fuel pump for pumping liquid fuel from a fuel reservoir along a fuel delivery line to an outlet, a vapor pump for returning fuel vapors from proximate the liquid fuel outlet along a vapor return line to a vapor repository, an electrically-activatable valve in the vapor return line, and a controller which monitors when the liquid fuel pump is operating and outputs an electrical signal to open the valve when the liquid fuel pump is operating and to close the valve when liquid fuel pump operation is not detected. In a preferred embodiment the signal indicative of operation of the liquid fuel pump is a pulse train and the controller converts pulses in the pulse train to a logic level corresponding to a desired valve open or valve closed condition.

The invention may also be summarized as a dispensing system for dispensing volatile liquids such as hydrocarbon fluids for vehicles while collecting the vapors to reduce atmospheric pollution including a plurality of liquid dispensing means. Each dispensing means includes a hand-held nozzle and liquid valve means disposed at the end of a flexible hose for flowing liquid into the fuel tank of a vehicle under the control of an operator. Also included is a vapor collection means including a vapor intake means positioned to be closely adjacent, but not sealed with, the fuel tank including a normally closed vapor valve associated with each hand-held nozzle and operable in response to opening of the respective liquid valve of the respective nozzle for collecting vapors displaced from the fuel tank as the liquid is flowed through the liquid valve into the tank at a variable, controlled rate. A vapor suction means includes a vapor pump driven by an electrical motor and coupled to draw vapors from all of the plurality of vapor intakes associated with the plurality of liquid dispensing means, and delivering the vapor to vapor storage means.

A plurality of flow meter means are included, each for producing a first electrical signal representative of the rate of flow of liquid being dispensed from one of the respective nozzles. A digital processing means receives each of the first electrical signals and operates the vapor collection means at a controlled rate to pump vapors through the vapor intake at a volumetric rate having a predetermined relationship to the volumetric rate at which liquid is being flowed from the nozzles whereby substantially all fuel vapor will be delivered to the vapor storage means.

A different grade of hydrocarbon fuel may be dispensed from each of the nozzle and liquid valve means, and the digital processing means may include a point of sale display indicating the volume and cost of the fuel being dispensed. Preferably, each grade of hydrocarbon fuel is dispensed from a different storage tank, vapor within the storage tanks are in fluid communication, and the collected vapors are returned to the storage tanks.

In one embodiment, each hand-held nozzle and liquid valve means includes a vapor valve operated in synchronization with and in response to manual operation of the liquid valve means whereby only the vapor intake associated with the nozzle from which liquid is being dispensed will function to collect vapor.

If desired, the system may be configured so that more than one of the plurality of liquid dispensing means can be operated simultaneously and the vapor pump means is operated at a vapor flow rate to the total liquid volume being simultaneously dispensed from the plurality of liquid dispensing means. If so, preferably the liquid valve means and the vapor valve means are each proportioning valves which dispense liquid and collect vapor at a variable rate determined by the operator, and the liquid valve and vapor valve are interconnectively operated to maintain a predetermined ratio of vapor volume collected to liquid dispensed through each nozzle being operated regardless of the rate of flow of fuel through the respective nozzle.

The invention also provides several improved vapor recovery methods. These include a method of recovering fuel vapor in a vapor recovery fuel dispenser comprising pumping liquid fuel with a liquid fuel pump from a fuel reservoir along a fuel delivery line to an outlet, pumping fuel vapors from proximate the outlet along a vapor return line to a vapor repository with a pump that is not mechanically actuated by the liquid pump, monitoring the liquid and vapor pumping to ascertain whether liquid and vapor pumping are taking place substantially simultaneously, and disabling the vapor pump when it is ascertained that vapor pumping is taking place and liquid pumping is not taking place.

Another method of recovering fuel vapor in a vapor recovery fuel dispenser includes pumping fuel Vapors from proximate a liquid fuel outlet along a vapor return line to a vapor repository with a vapor pump, driving the vapor pump with a motor by providing a signal to operate the vapor pump, monitoring when the motor is operating, and disabling the vapor pump motor when motor operation is detected while not signaled to operate.

A further method of recovering fuel vapor in a vapor recovery fuel dispenser includes pumping fuel vapors from proximate a liquid fuel outlet along a vapor return line to a vapor repository with a vapor pump, driving the vapor pump with an electric motor, monitoring the electrical current to the motor, and disabling operation of the vapor pump motor when the monitored current indicates a system error.

The invention provides a method of dispensing a plurality of grades of liquid fuels from a corresponding plurality of liquid storage tanks at a single point of sale through a corresponding number of hand-held nozzles each having a normally closed fuel valve and a normally closed vapor valve into a fuel tank having a filler neck.

The method includes on demand from a customer's simultaneous operation of the fuel and vapor valves of a selected nozzle, pumping fuel from the corresponding storage tank through a meter to the customer's fuel tank having a filler neck while producing an electrical signal representative of the volume flow rate of the fuel.

The method also includes digitally processing the electrical signal and operating an electrically driven vapor pump connected to allow the vapor valve, which is positioned closely adjacent to, but not sealed with, the fuel tank, when open to collect vapors displaced from the fuel tank by a vacuum intake disposed adjacent but not sealed with the filler neck of the customer's fuel tank at a vapor volume flow rate having a predetermined relationship to the fuel flow rate represented by the electrical signal.

The pumped vapors are discharged to a vapor manifold interconnecting all of the storage tanks. Preferably, the method also includes digitally processing the electrical signal to calculate the total volume of the selected fuel being dispensed to the customer's tank and the total cost, and displaying the volume and cost information to the customer at the point of sale.

The thermal expansion or contraction of the vapor may be compensated for by controlling the volumetric rate of the vapor pump to a level higher or lower than otherwise projected. The amount of adjustment is determined in large part by the ratio of-the absolute temperature of the liquid to the absolute temperature of the vapor. Appropriately located conventional transducers may be used in making the temperature measurements. Also, in a practical system, it is preferred to use the ambient or atmospheric temperature as an estimate of the initial vapor temperature $T_V$. In most situations the initial temperature, $T_V$, of the vapor in the tank being filled is approximately the same as the atmospheric or ambient temperature $T_A$. A thermistor or other appropriate type transducer, for example, mounted in the product flow path may be used to measure the product temperature $T_L$.

In accordance with another aspect of this invention, compensation is made for any difference between the actual volumetric flow, $V_A$, of the recovery pump and the ideal flow, $V_R$, that can be caused by such things as pump wear and differences between pumps due to variations within tolerance limits. This is accomplished by measuring the actual flow $V_A$, deriving the difference between it and $V_R$, and controlling the recovery pump so that $V_A=V_R$.

An advantage of the invention as disclosed herein and in our earlier patent applications Ser. No. 625,892 filed Dec. 11, 1990 and its continuation Ser. No. 824,702 filed Jan. 21, 1992 (now U.S. Pat. No. 5,156,199), is that the nozzle used to fill the automobile tank need not be equipped with bellows or other face sealing means. Gasoline customers who use vapor recovery fuel dispensers have found such bellows or seals to be cumbersome and difficult to use. Also, when the seals are used in a balance system vapor recovery installation, if the seal is not perfect, vapor can leak, defeating the environmental advantages sought to be obtained. By doing away with such seals, applicant has been able to do away with the problems attendant thereto.

BRIEF DESCRIPTION OF THE DRAWINGS

The invention will be better understood from a reading of the detailed description of the preferred embodiments along with a study of the drawings in which.

DETAILED DESCRIPTION OF THE PREFERRED EMBODIMENTS

Temperature Compensation

Figure 1:
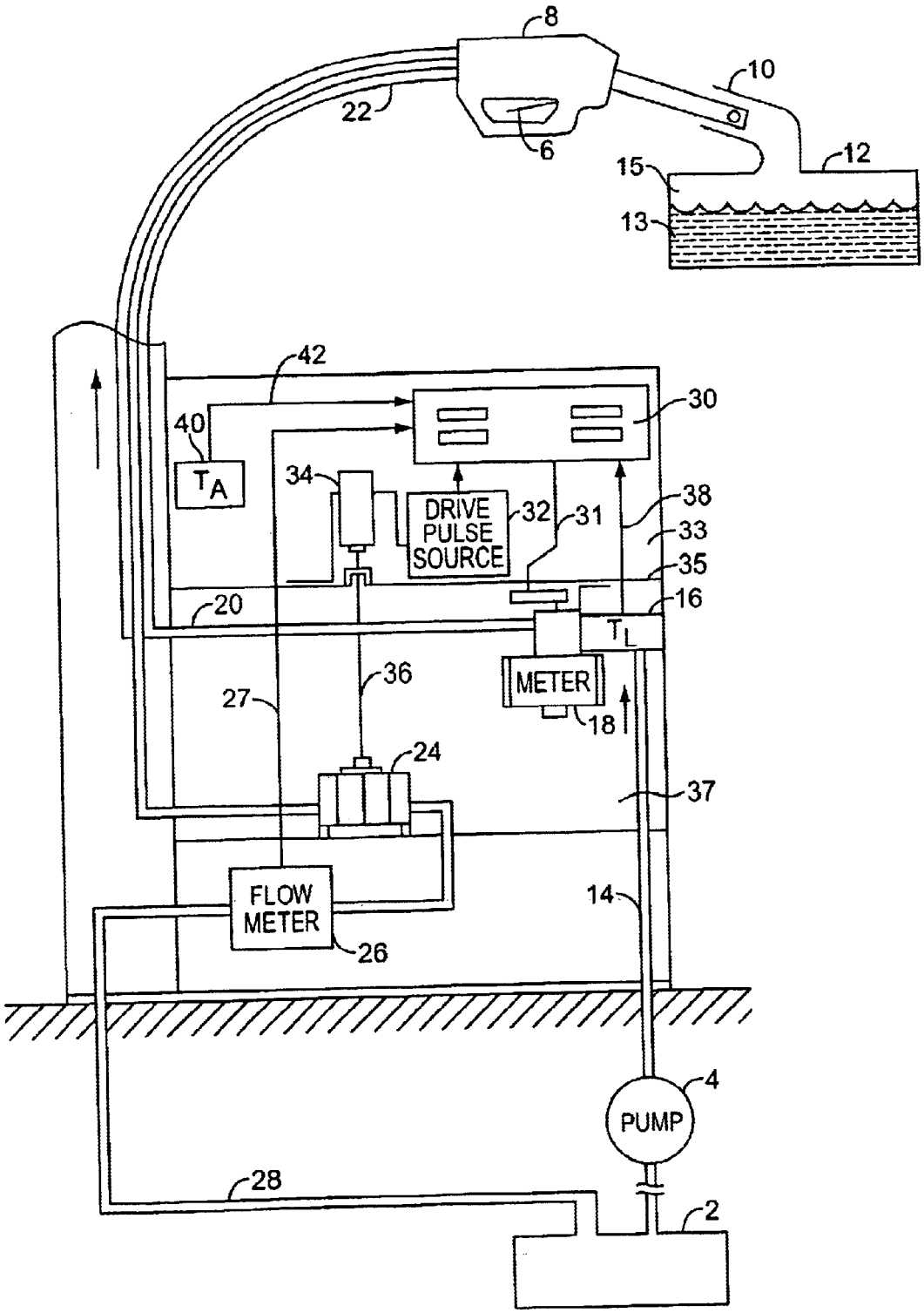
FIG. 1 is a schematic representation of the delivery system for volatile liquid constructed in accordance with the invention.

In the embodiment of the invention shown in FIG. 1, liquid is pumped from a reservoir 2 by a pump 4 with a volumetric flow $V_L$ that is determined by the position of a trigger 6 of a nozzle 8. The nozzle 8 is a bellows-free and seal-free nozzle, such as the one described in U.S. Pat. No. 4,199,012, for example, and is inserted into the fill pipe 10 of a tank 12 that is to be filled with liquid 13. The liquid flows to the nozzle from the pump 4 via a tube 14, a temperature transducer 16, a flow meter 18, and a tube 20.

As vapor 15 is forced from a tank 12, it is drawn through a tube 22 by a pump 24 that forces it through a flow meter 26 and a tube 28 to the reservoir 2.

As described below, means are provided for initially driving the recovery pump 24 at such speed that its volumetric flow, $V_V$, equals the volumetric flow, $V_L$, of the liquid produced by the pump 4. Signals from the flow meter 18 are applied via a lead 31 to a microprocessor 30 that is programmed to supply a control signal to a drive pulse source 32 that supplies drive pulses to a motor 34. The motor 34 is mechanically coupled via a rod 36 to drive the recovery pump 24. The frequency of the drive pulses supplied by the source 32 is such that the motor 34 drives the recovery pump 24 at such a speed a to cause $V_V=V_L$.

The volumetric flow of the recovery pump 24 may be modified as follows to accommodate the change in volume of the vapor emanating from the tank 12. The signal provided by the temperature transducer 16 representing the temperature, $T_L$, of the liquid flowing to the tank 12 is conducted to the microprocessor 30 via a lead 38. A temperature transducer 40 supplies a signal representing the atmospheric or ambient temperature $T_A$ to the microprocessor 30 via a lead 42. The microprocessor 30 modifies the control signal supplied in the drive pulse source 32 in a manner described in FIG. 2 so as to change the nominal volumetric flow $V_V$ of the recovery pump 24 to the ideal value $V_R$.

Figure 2:
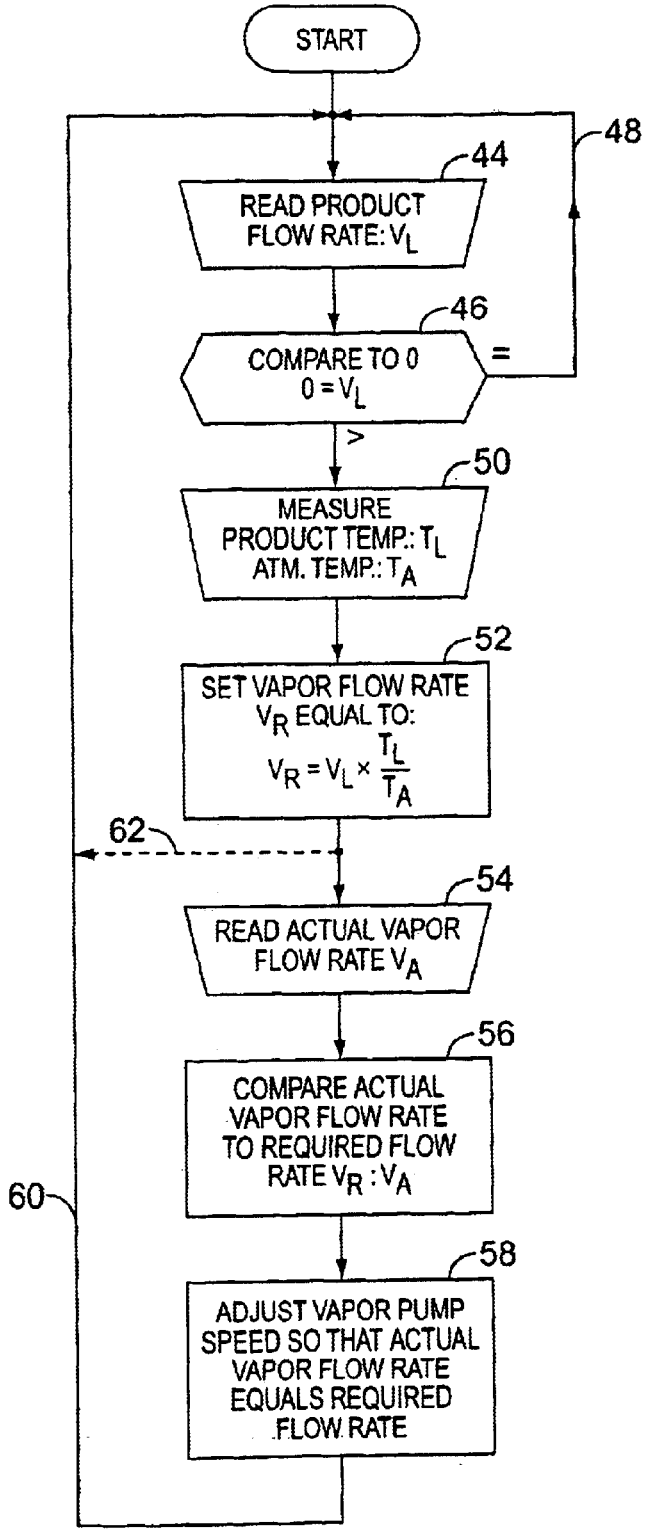
FIG. 2 is a flow chart used in explaining the operation of the delivery system shown in FIG. 1.

Reference is now made to the flow chart of FIG. 2. At the start of the program, the microprocessor 30 reads the signal $V_L$ on the lead 31 as indicated by a block 44. A determination is made as to whether any liquid is flowing by comparing $V_L$ with zero, block 46. If $V_L$ =0, the process returns to the block 44, via line 48.

When block 46 indicates that $V_L>0$, a block 50 indicates that the microprocessor 30 reads the signals on the leads 38 and 42 respectively representing the temperature, $T_L$, of the liquid and the temperature, $T_A$, of the atmosphere. In block 52, the signal supplied to the pulse drive source 32 is changed, if required, to a value reflecting the ratio of the liquid temperature to the vapor temperature.

Thus far, it has been assumed that the actual volumetric flow $V_A$ of the recovery pump 26 corresponds precisely to the ideal value $V_R$, but, as indicated previously, this may not always be the case because of differences between pumps and wear. If desired, the ideal value of $V_R$ can be attained by the microprocessor reading the signal on the lead 27 representing actual vapor flow, $V_A$, as Indicated by block 54, comparing it with the Ideal value $V_R$, which it has computed from $T_L$, $T_A$ and if need be by block 56, and changing the signal supplied to the drive pulse source 32 to a value such that $V_A=V_R$, as indicated by a block 58. The process then returns to the start at the block 44.

Note that in the embodiment of the invention shown in FIG. 1, the electrical apparatus is enclosed in a non-hazardous zone 33 above a vapor barrier 35. The fluid handling mechanical apparatus are enclosed below vapor barrier 35 in a hazardous zone 37. Such an arrangement is useful for a gasoline dispenser, for example.

If correction for deviation of the actual volumetric flow, $V_A$, from the ideal volumetric flow is not desired, the procedure can be returned to its start after the block 52 as indicated by the dashed line 62. In either case, the process is repeated rapidly enough to follow changes in the volumetric flow of liquid $V_L$ as well as changes in other parameters such as $T_L$ and $T_A$.

Multi-product Dispensers

Figure 3:
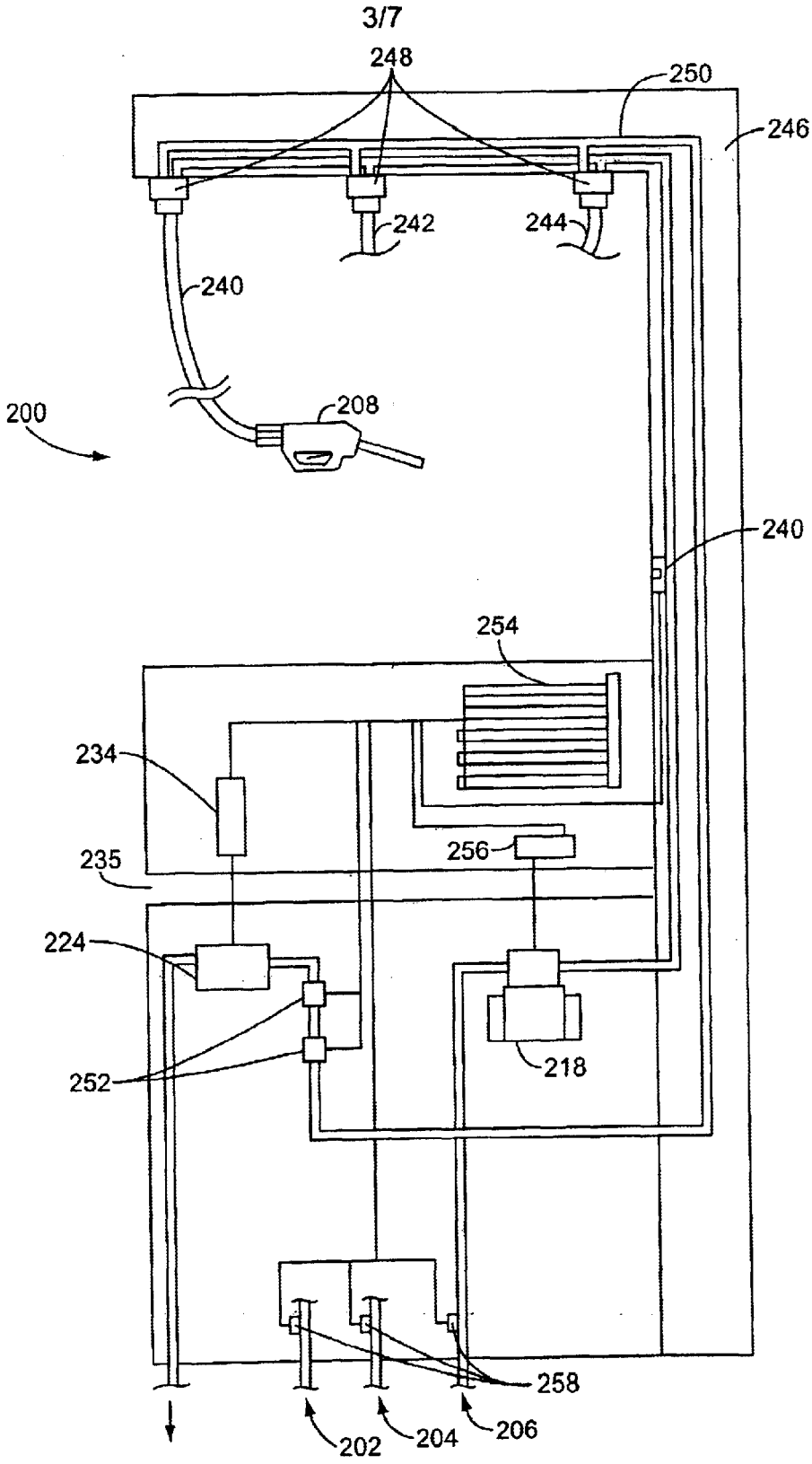
FIG. 3 is an alternate schematic representation of the delivery system, emphasizing use of the vapor recovery components in a multi-product, multi-hose fuel dispenser.

FIG. 3 illustrates an embodiment similar to FIG. 1, focusing more on the application of the invention to a multi-product dispenser. The dispenser 200 is capable of dispensing different grades of gasoline through different hoses, supplied from different underground pipes 202,204, 206. Each underground pipe extends to a separate underground tank, as is conventional. In the depiction of FIG. 3, pipes 202,204 are shown merely in schematic form, but pipe 206 extends into the dispenser pass a meter 218 and is shown in schematic form extending to each of three hose assemblies 240,242,244. As will be apparent, the depiction of FIG. 3 is abbreviated for the sake of simplicity. A practical embodiment would have product supply pipe 202 connected with hose 240, product supply pipe 204 connected with hose 242, and product supply pipe 206 connected with hose 244, each having a meter and without product intermingling. Each of the hoses 240,242,244 has a liquid supply path and a vapor recovery path terminating in a nozzle 8, all the same as described above with respect to the embodiment of FIG. 1.

Each hose is affixed to the upper piping housing 246 of the dispenser through a vapor valve/hose casting 248. The vapor valve can be any suitable valve designed to shut off inactive hoses, when desired. For example, the valves may be product-operated valves, solenoid valves or the like. The vapor return lines extend past the valves 248 to a common manifold 250 which extends back down to the lower part of the dispenser 200 to vapor pump 224. As can be appreciated, the single vapor pump 224 services all three of the hoses 240,242,244. The inactive ones of the hoses are closed off by the closing of their associated vapor valves. If desired, vapor flow pressure sensors 252 may be included upstream of the pump 224 to provide pressure data back to controller 254.

Also supplied to controller 254 are the outputs of pursers 256 linked to the liquid flow meters 218 in conventional fashion. Pulsers 256 are the conventional pulsers used in modern gasoline dispensers to provide an indication of the amount of liquid gasoline being dispensed. The output of the pulser is used to derive the display to a customer, not shown in FIG. 3 of the amount of gas dispensed and its cost. The ambient temperature may be sensed by temperature sensor 240 and applied to the controller 254, and the temperatures of the respective gasolines being dispensed may be sensed by sensors 258 and similarly applied to the controller 254.

Controller 254 acts on the volumetric liquid flow rate output by pulser 256 to output a control signal to motor 234. If desired, it may also act on the atmospheric temperature signal from sensor 240 and the product temperature from sensors 258, as discussed with reference to FIG. 1. Motor 234 has its shaft connected to vapor pump 224 across air gap 235, as in the embodiment of FIG. 1. Thus, the liquid flow rate as determined by the pulsers is used to drive the vapor pump 224 to retrieve all of the vapors generated approximate the nozzle 208 of the active hose. The vapor being drawn by the pump 224 comes only from the active hose by virtue of the closure of the valves of the two inactive hoses. The vapor may be pumped at a rate further modulated by the temperature sensing as indicated above, or by the pressure as sensed by pressure sensors 252.

Figure 5:
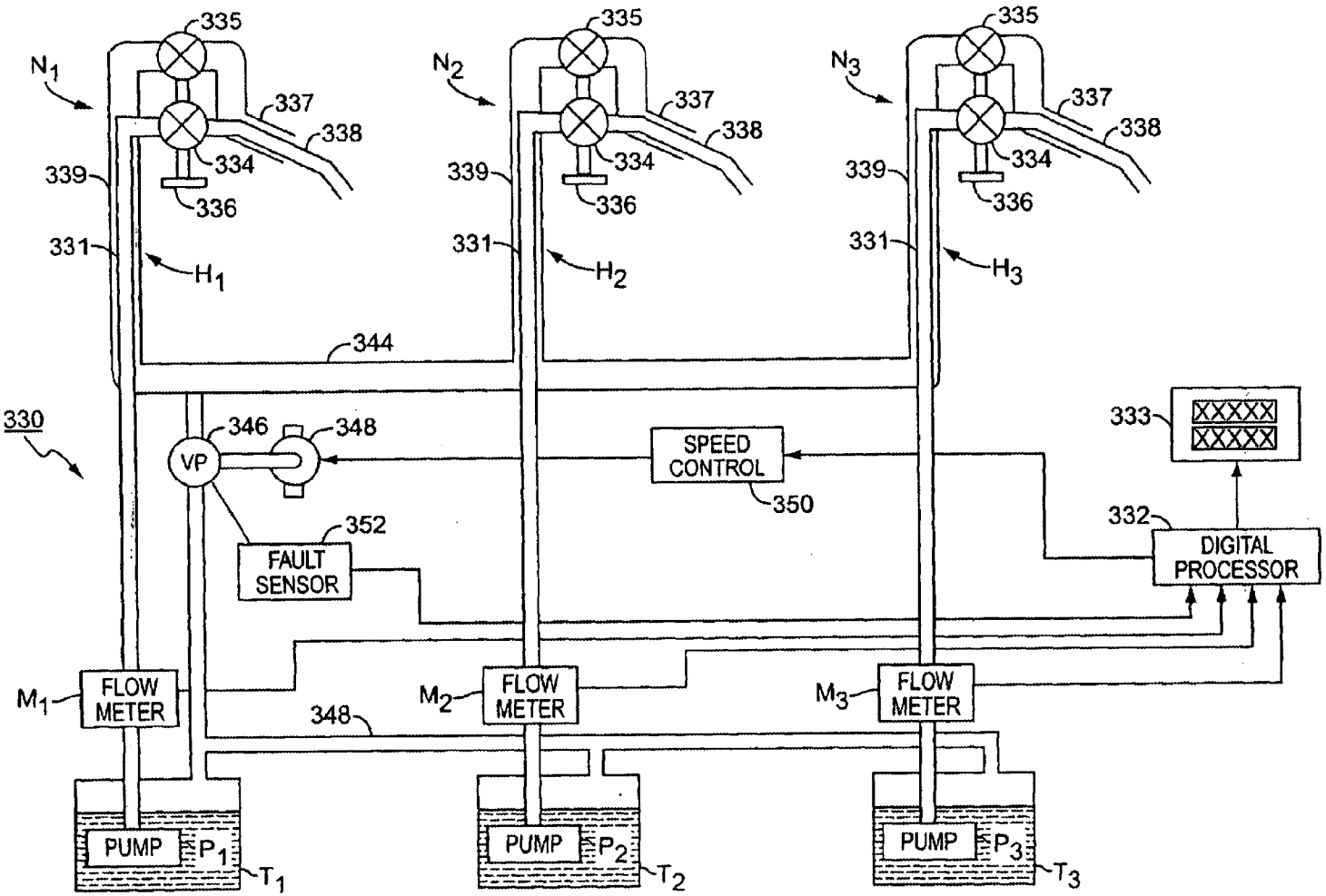
FIG. 5 is a somewhat more detailed schematic view of the delivery system of FIGS. 3 and 4, further emphasizing use of the vapor recovery components in a multi-product, multi-hose fuel dispenser.

FIG. 5 discloses a further view of virtually the same invention as invention disclosed in FIG. 3, differing in only the level of detail depicted. Three underground tanks $T_1$,$T_2$, $T_3$ are provided having outlets driven by pumps $P_1$,$P_2$,$P_3$, respectively, past flow meters $M_1$,$M_2$,$M_3$ to nozzles $N_1$,$N_2$, $N_3$, respectively. The output of the three flow meters, entirely analogous to the pulsers and meters shown in FIG. 3, is applied to a digital processor 332. The digital processor 332 drives a visual display 333, as is conventional. Digital processor 332 also outputs a signal to a speed control 350 which, in turn, controls a motor 348 having its drive shaft connected to a vapor pump 346.

Each nozzle has a liquid dispensing spout 338 and a chamber 337 to receive vapor displaced by the liquid being dispensed into an automobile nozzle. The chamber 337 communicates with a passageway 339 back to a manifold 344. The spout 338 communicates with a liquid passageway 331 extending back to the respective flow meter M for that nozzle N. Each nozzle includes valves 334,335, both actuated by a nozzle lever 336. The valve 334 selectively permits passage of liquid out through the spout 338. The valve 335 selectively permits return of vapor from the chamber 337. As will be appreciated, the nozzle described in U.S. Pat. No. 4,199,012 or U.S. Pat. No. 4,429,725 may be substituted, in which the vapor valve opens as a response to the movement of liquid through the liquid portion of the nozzle, as distinct being rigidly linked as depicted in FIG. 5.

The respective vapor paths 339 are joined at a manifold 344 from which the vapor is drawn by the vapor pump 346 back to a manifold 348 connected with the three tanks $T_1$,$T_2$,$T_3$. A vapor pump operation sensor 352, such as one or more of those described below with respect to FIG. 4 may be included. These will shut down the operation of the dispenser by outputting a signal to the processor 332 when an error is detected.

In operation, the selection of one of the nozzles $N_1$,$N_2$,$N_3$ by a customer may permit the beginning of vapor recovery fuel dispensing. For example, if nozzle $N_3$ is selected, it is inserted into the filler pipe of the automobile gas tank. The plunger 336 is depressed, thereby opening the valves 334, 335 of nozzle $N_3$. Pump $P_3$ is activated in conventional fashion to pump liquid from tank $T_3$ through meter $M_3$ out through the spout 338 of nozzle $N_3$. The movement of the liquid through the flow meter $M_3$ applies a signal to digital processor 332 to output a display of the quantity dispensed and its cost on display 333. The digital processor 332 also outputs a signal to the speed control 350 to drive the pump motor 348 at a speed appropriate to draw vapor through the vapor pump 346 to retrieve substantially all of the vapor being displaced by the liquid emanating from the nozzle $N_3$. Since the vapor valves 335 of nozzles $N_1$,$N_2$ are closed, all of the vapor being pumped by the pump 346 is drawn from the chamber 337 of nozzle $N_3$. Downstream of the vapor pump 346, the vapor is directed through the manifold 348 and is made available to the three tanks $T_1$,$T_2$,$T_3$. However, since it is tank $T_3$ which is being depleted by the liquid pumping, the vapor in manifold 348 is preferentially deposited in the head space of tank $T_3$, although it is also free to pass into tanks $T_1$,$T_2$.

If desired, the output of the digital processor 332 and/or the speed control 350 may be modified in accordance with the temperature compensation or pressure compensation or other control features described above.

Figure 4:
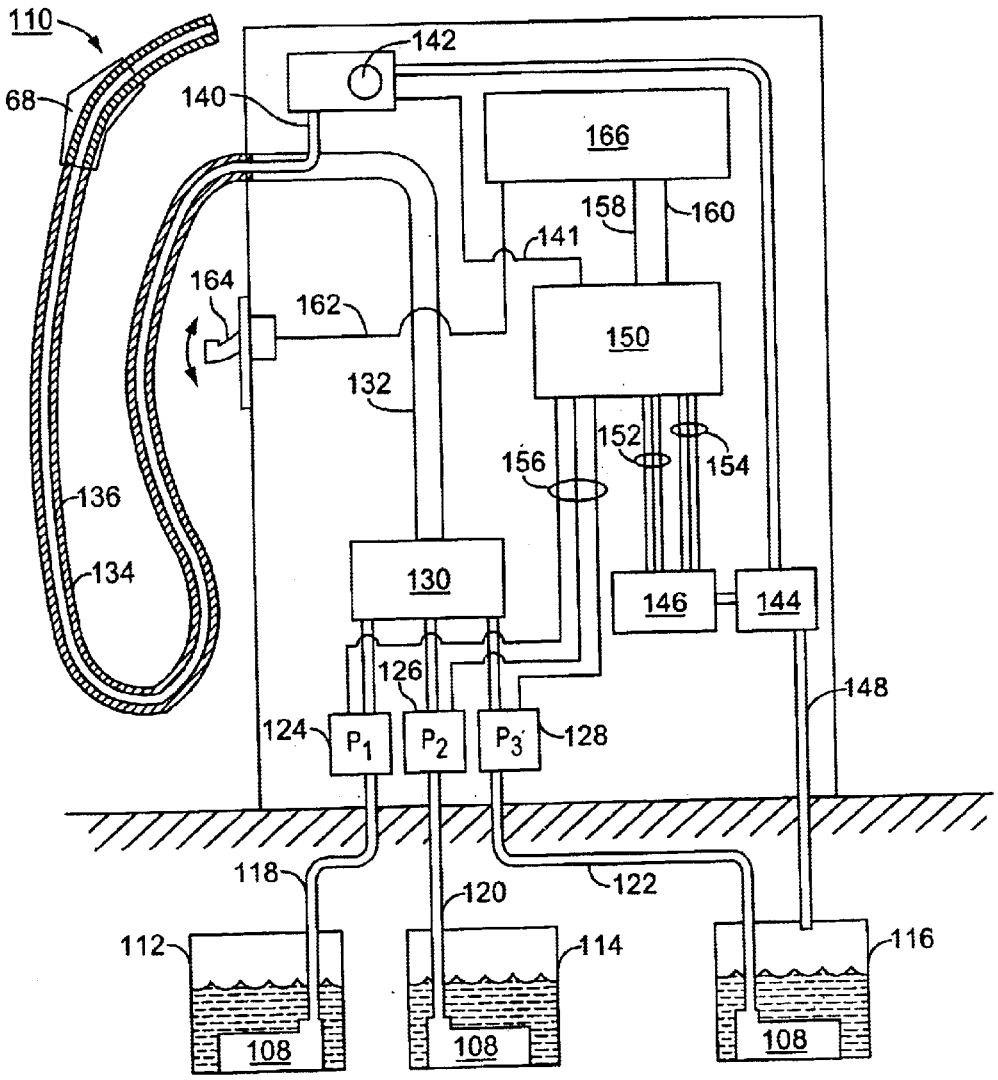
FIG. 4 is a further schematic representation of the delivery system, emphasizing use of the vapor recovery components in a multi-product, multi-hose fuel dispenser.

A modified embodiment of the invention is shown in schematic form in FIG. 4. The fuel dispenser 110, preferably a gasoline dispenser, is connected to a multiplicity of turbine pumps 8 in gasoline storage tanks 112,114,116 through pipes 118,120,122, respectively. The pipes draw gasoline from the tanks and the respective liquid flow rates are measured in meters 124,126,128. The fuel from the pipes is mixed in mixing manifold 130. The mixing manifold has downstream of it a pipe 132 which outlets to a hose 134, terminating in a controllable dispensing nozzle 138. The nozzle 138 is provided with a vapor return line which connects with a vapor return hose 136 in the hose 134, preferably concentrically within it. The vapor return line 136 connects with a vapor line 140 extending to a vapor pump 144. An electrically operated solenoid valve 142 is provided in line 140 to close off the vapor line when not in use.

A conventional handle 164 is mounted in the outside wall of the dispenser 110, on which the nozzle 138 can rest when not in use. As is conventional, the handle 64 is pivotally mounted, so it can be lifted after the nozzle is removed to activate a switch, and the activation of the switch is signalled along line 162 to a transaction computer 166.

Controller 150 is provided with electrical connections 156 with the meters 124,126,128, so that signals indicative of the liquid flow rate can be transmitted from the meters to the controller 150. Preferably the meters 124,126,128 include pulsers, such as are commonly used in gasoline dispensers made by Gilbarco, Inc. The pulsers emit a pulse for every 1/1000th of a gallon of gasoline passed by the pump. Thus, as the fuel is being pumped, a pulse train is delivered on the respective lines of the connections 156, with the pulse train frequencies corresponding to the liquid flow rate. The liquid pumps may, of course, be located in the dispenser 110, or elsewhere, and may have the metering devices integral with them. As is conventional, the pulser data is accumulated to show the amount of fuel dispensed and its cost. This is not shown in FIG. 4, for simplicity.

Various other tank, pump and meter arrangements can also be used. In particular, the invention is useful for dispensers in which the output of each meter is passed to a separate hose, without any mixing. In such a case, the signals output on lines 156 will be exclusive; i.e. there will be a signal indicative of liquid flow only on one of the lines at a time. Dispensers of this type are sold by Gilbarco, Inc. under the MPD designation.

The vapor of the vapor pump 144 is transmitted along line 148 back to a storage vessel. The returning vapor can be transmitted via a manifold system to the plurality of tanks 112,114,116 as shown in FIG. 5 or, as shown more simply in FIG. 4, to one tank. The manifold system is preferred.

Controller 150 also has a connection 141 to the valve 142 to open or close that valve, as desired. Controller 150 also has connections 158,160 to the transaction computer 166 which controls the overall operation of the dispenser 110, in conventional fashion. Line 158 transmits signals from the transaction computer 166 to the controller 150 indicating that pumping is desired, and line 160 transmits signals from the controller 150 to disable pumping, when the controller 150 has ascertained that pumping should be disabled. This will be discussed in more detail later.

The vapor pump 144 is preferably a positive displacement pump, such as the Blackmer Model VRG3/4. It is driven by a motor 146, preferably a brushless three-phase DC motor. The brushless DC motor 146 includes three hall effect sensors, one for each phase of the three-phase motor. These are used in conventional motor drive electronics in the controller 150 to apply appropriately phased power to the three phase motor 146. The hall effect signals are a form of feedback and indicate the angular displacement of the motor. Rates of change of angular displacement signalled by the hall effect sensors by a pulse frequency are sent over lines 152 to the controller 150. That is, the lines 152 provide a tachometer reading of the rate of rotation of the motor 146. The motor drive electronics portion of the controller 150 outputs three-phase power over lines 154 to the motor to drive the motor as desired. Of course, if desired, the motor can be separately driven with a separately denominated motor drive which takes its instructions from the controller 150.

The controller 150 plays a number of important roles which will be described in more detail in subsequent sections. However, to generalize, the flow rate of the liquid being pumped through the lines 118,120,122 as controlled by the transaction computer 166, via a connection not shown, is transmitted to the controller 150 over lines 156. The controller 150 evaluates the pulse trains 156 and output signals over lines 154 to the motor 146 to drive the vapor pump 144 at a rate correlated with the liquid pumping rate. Thus, generally the faster the liquid is pumped out, the faster the vapor is retrieved.

However, the controller 150 also includes circuitry to compare whether liquid is passing the meters 124,126,128 with whether the motor 146 is being driven. In the event that the motor 146 is running, and therefore pumping vapor back to the tank 116, when liquid is not passing, the controller can disable the motor 146 to prevent the air from being pumped into the tanks 112,114,116. Similarly, the controller 150 can combine the flow rates of multiple meters whose output is mixed, to get an overall liquid flow rate to output a proper vapor pump flow rate to the motor 146. Further, the controller 150 ascertains when the liquid is passing the meters (or in an alternative embodiment, when the motor 146 is being driven) and passes a signal on line 141 to open the valve 142. Further, the controller 150 includes circuitry which monitors the current drawn by the motor 146. When the current is drawn at a rate which is uncharacteristic of normal vapor pumping, it can determine an error condition, such as liquid clogging the vapor return line and disable the vapor pump.

Vapor Line Valve

Figure 6A:
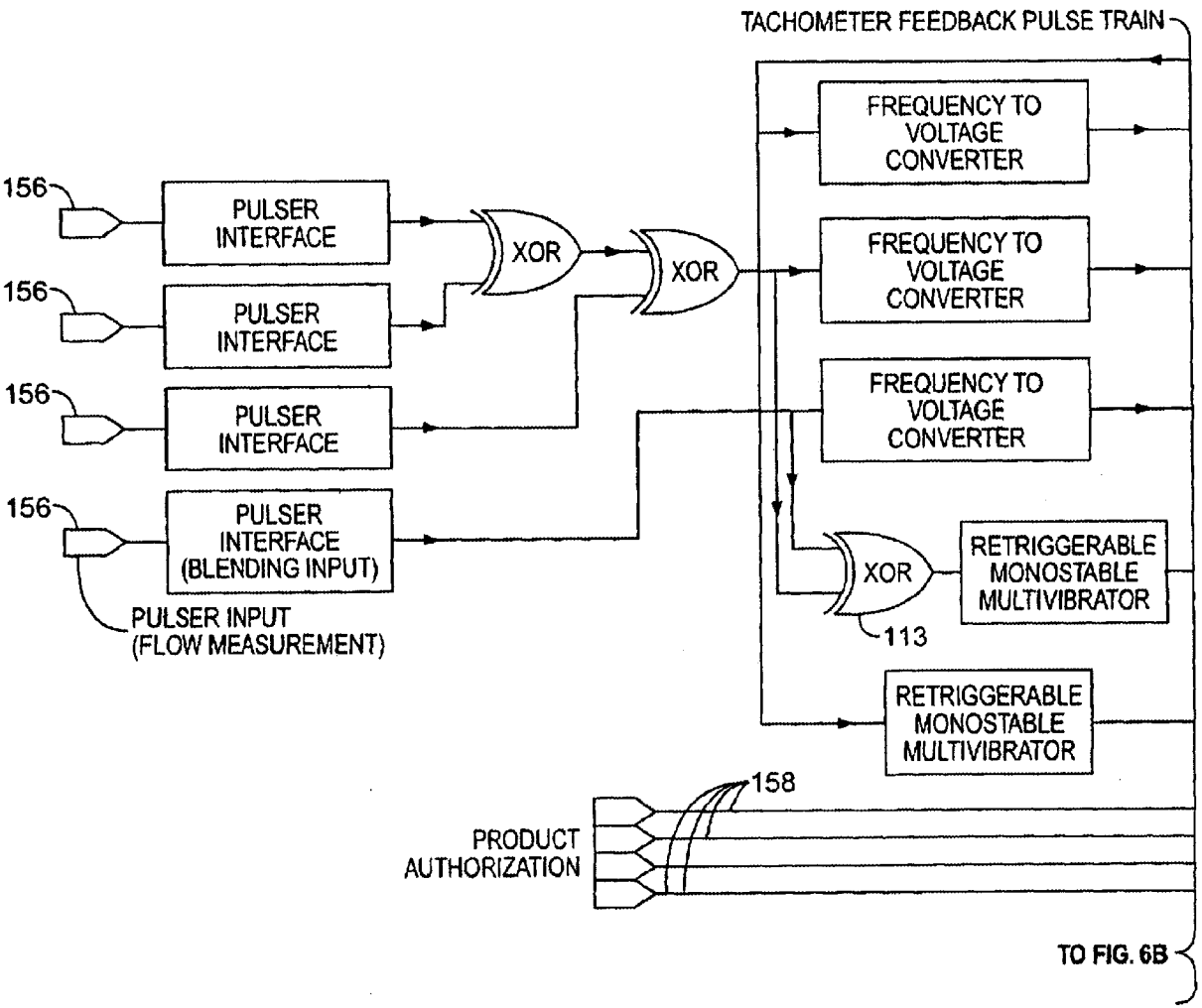
FIGS. 6A and 6B are block circuit diagrams showing electronic control components as used in the apparatus depicted in FIG. 4.
Figure 6B:
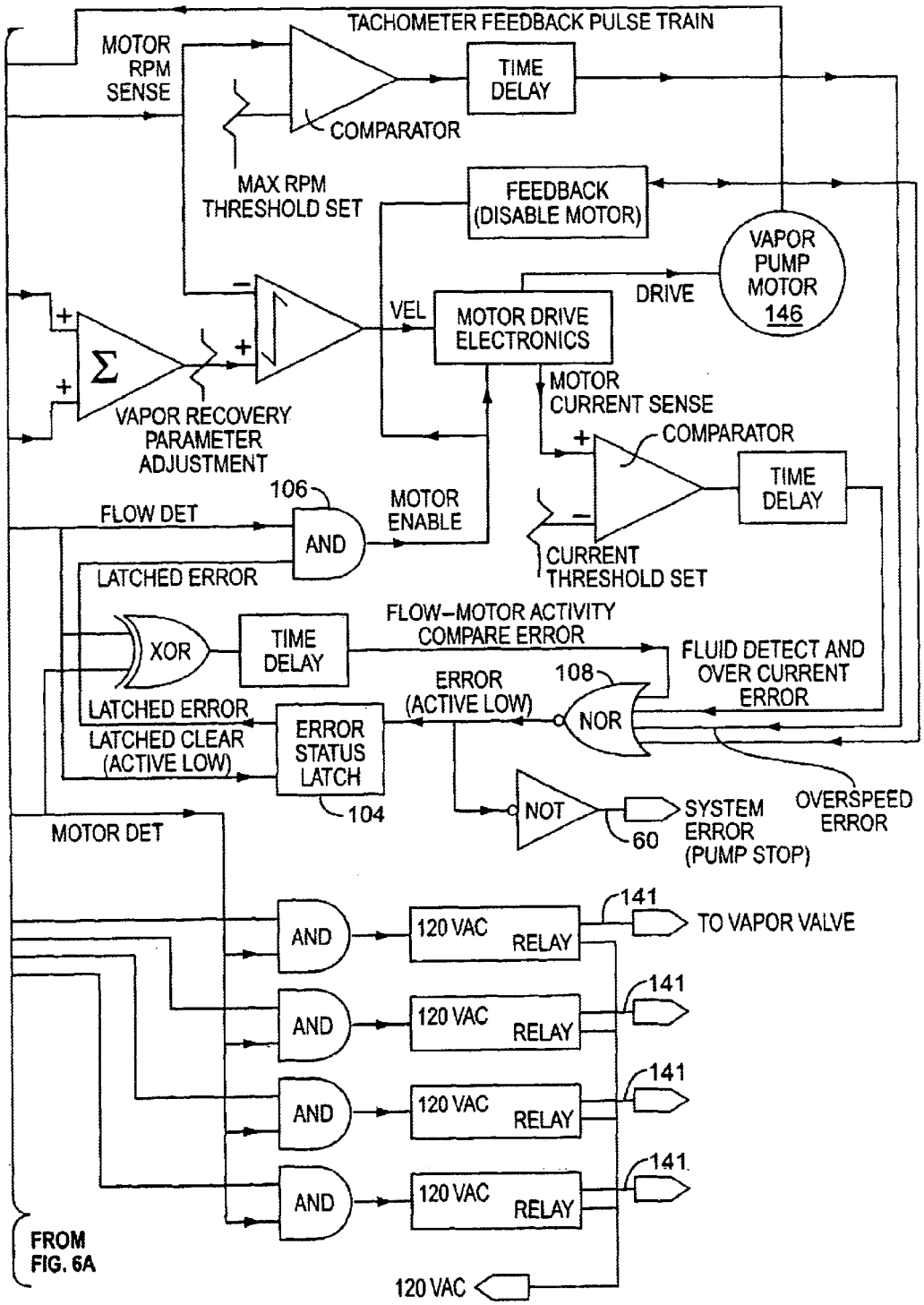

FIGS. 6A and 6B depicts a circuit for opening the solenoid valve 142 (FIG. 4) when vapor pumping is to be implemented. Various other hardware and software embodiments may be employed. In this embodiment, vapor pump rotation is detected by combining the tachometer feedback signals 152 from the hall effect sensors of motor 146 in exclusive OR gates. Thus, rotation becomes noticed by transitions at the output of the exclusive OR gate. One shot then converts the pulse train into a stable logic level signal by functioning as a retriggerable one shot whose period is greater than the typical minimum pulse width produced by the motor feedback signals during operation. This signal, the output of the one shot, is then used to gate the vapor solenoid valve by outputting the signal on line 141.

It should be noted that alternately (or in conjuncton) the presence or detection of liquid fuel flow (i.e., the signals on line 156) may be substituted for (or logically combined with) the presence or detection of vapor pump motor rotation. This substitution (or combination) is possible because in a working system, vapor pump motor rotation will be a function of liquid fuel flow.

During periods of motor rotation where the vapor pump is actively moving vapors from the nozzle to the vapor return lines, the signal output on line 141 is true, and the vapor solenoid valve 142 may be opened with assured direction of flow. During periods of no motor rotation, that signal becomes false, closing the valve and preventing the escape of vapors via system back pressure.

The system eliminates the escape of vapors into the atmosphere during idle dispensing periods and eliminates the need for a check valve in the vapor return line or dispensing nozzle. Also, since the valve is not located in the nozzle, which is subject to accident, breakage and abuse, the cost of replacement of the nozzle is lessened by locating the valve in the dispenser.

The circuit shown in FIGS. 6A and 6B also includes an Error Status Latch 104, which latches an error signal out to AND gate 106 to disable the motor drive electronics whenever any of the error conditions are noticed in NOR gate 108. The latch is reset by a clearing input form the signals 156 when the liquid pump is next restarted. If the error is cleared, operation may resume. If not, the error will be detected and again disable the dispenser.

While the invention has been disclosed with respect to a particularly preferred embodiment, those of ordinary skill in the art will appreciate that the functionalities obtained can be obtained through numerous other systems, electrical, mechanical and hardware. The present invention is deemed to be broad enough to encompass apparatus of such sort. Similarly, the invention includes methods of operation of the vapor recovery liquid fuel dispenser as outlined herein. The circuitry has largely been described with reference to analog operation, but those of ordinary skill in the art will be able without undue experimentation to devise digital circuitry to accomplish the same functionalities, and such digital circuits are deemed to be within the scope of this invention.

What is claimed is:

1. A dispensing system for dispensing volatile liquids such as hydrocarbon fuel for vehicles into a tank having a filler neck while collecting the vapors to reduce atmospheric pollution comprising:

fuel dispensing means including at least one hand-held nozzle for insertion in the filler neck of a tank and a manually operated valve for providing a variable volume flow rate of fuel into the tank;

means for providing an electrical signal indicative of the volumetric flow rate of said fuel delivery means;

vapor collection means having a controllable volumetric flow rate, said vapor collection means including vapor intake means attached to the hand-held nozzle and when the nozzle is inserted in the filler neck of the tank being positioned closely adjacent to, but not sealed with, the filler neck for drawing vapor displaced from the tank by delivery-of fuel and for conveying it to a vapor receiving tank; and means responsive to said electrical signal for making the volumetric flow of said vapor collection means greater than the volumetric flow of said fuel dispensing means.

2. A dispensing system for dispensing volatile liquids such as hydrocarbon fuel for vehicles into a tank having a filler neck while collecting the vapors to reduce atmospheric pollution comprising:

a fuel delivery hose including a hand-held nozzle for insertion in the filler neck of a tank;

means for providing an electrical signal indicative of the volumetric flow rate of the fuel delivery through the fuel delivery hose;

a vapor collection hose including a vapor intake connected to the hand-held nozzle and positioned closely adjacent, but not sealed with the tank to collect vapor displaced from the tank by fuel being delivered to the tank;

a vapor pump coupled to said vapor collection hose so as to be capable of withdrawing liquids through it; and control means responsive to said signal for controlling the vapor pump to produce a volumetric flow rate in said hose slightly greater than the volumetric flow rate of the fuel.

3. A dispensing system for dispensing volatile liquids such as hydrocarbon fuel for vehicles into a tank having a filler neck while collecting the vapors to reduce atmospheric pollution comprising:

a fuel delivery hose including a hand-held fuel valve and nozzle for insertion in the opening of the tank;

a means for delivering fuel under pressure to the fuel delivery hose;

means for providing electrical pulses corresponding to the volumetric flow of liquid through said fuel delivery hose when the fuel valve is open;

a vapor recovery hose including a vapor intake connected to the hand-held nozzle for insertion in tire opening of the tank without sealing with the tank;

a motor driven vapor pump for producing a volumetric flow through the vapor recovery hose corresponding to a signal applied to said motor; and a digital processing means, for producing the signal applied to the motor in response to the electrical pulses to produce a volumetric flow of vapor slightly greater than the volumetric flow of fuel to the tank.

4. A dispensing system for dispensing volatile liquids such as hydrocarbon fuel for vehicles into a tank having a filler neck while collecting the vapors to reduce atmospheric pollution comprising:

a liquid fuel dispensing means including a hand-held unit with a fuel valve and a nozzle insertable in the filler neck of a fuel tank;

means for metering the flow rate of the liquid fuel being dispensed and producing an electrical signal representing the liquid fuel flow rate;

vapor collection means including a vapor hose having a vapor intake attached to the hand-held unit and insertable within but not sealable with the filler neck of the fuel tank and a variable speed suction pump to draw fluid through said vapor intake and hose; and digital processing means for operating said variable speed suction pump to maintain the rate of fluid pumped to be greater than the liquid fuel flow rate.

5. A dispensing system for dispensing volatile liquids such as hydrocarbon fuel for vehicles into a tank having a filler neck while collecting the vapors to reduce atmospheric pollution comprising:

liquid fuel delivery means for delivering a grade of fuel from a storage tank including a nozzle insertable in the filler neck of a fuel tank and means for monitoring the flow rate of the liquid fuel being delivered and outputting an electrical signal indicative of the liquid flow rate;

a vapor collection apparatus including a vapor hose having a vapor intake attached to the nozzle and insertable within but not sealable with the filler neck of the fuel tank and a variable speed vapor suction pump for pumping vapor through said vapor intake and hose; and digital processing means for operating the vapor suction pump at a controlled rate to collect a greater volume of vapor than volume of liquid fuel dispensed.

6. A dispensing system for dispensing volatile liquids such as hydrocarbon fuel for vehicles into a tank having a filler neck while collecting the vapors to reduce atmospheric pollution comprising:

at least one liquid dispensing means including a hand-held nozzle and liquid valve means disposed at the end of a flexible hose for flowing liquid into the fuel tank of a vehicle under the control of an operator operating the liquid valve;

vapor collection means including:

a vapor intake means manipulated with the hand-held nozzle so as to be positioned closely adjacent, but not sealed with, the fuel tank during delivery of fuel to the tank; and vapor suction means including a vapor pump driven by an electrical motor and coupled to draw vapor through the vapor intake and deliver the vapor to vapor storage means;

a flow meter for producing a first electrical signal representative of the rate of flow of liquid being dispensed from the nozzle; and digital processing means for receiving the first electrical signal and operating the electric motor at a controlled rate to draw vapors through the vapor intake at a volumetric rate slightly greater than the volumetric rate at which liquid is being flowed from the nozzle whereby substantially all fuel vapor displaced from the tank will be delivered to the vapor storage means while minimizing delivery of air to the vapor storage means.

7. A dispensing system for dispensing volatile liquids such as hydrocarbon fuel for vehicles into a tank having a filler neck while collecting the vapors to reduce atmospheric pollution comprising:

a fuel delivery hose including a hand-held nozzle for insertion in the filler neck of a tank;

a pump for said delivery hoses for providing a flow of fuel of a grade to the nozzle;

a vapor recovery hose including a vapor intake connected to each hand-held nozzle and positioned closely adjacent, but not sealed with the opening of the tank to collect vapor displaced from the tank by fuel being delivered to the tank;

a vapor pump connected to said recovery hoses so as to be capable of withdrawing a flow of fluid through each recovery hose;

signaling means for providing an electrical signal indicative of the volumetric flow in each of the fuel delivery hoses; and control means responsive to the electrical signals for controlling the vapor pump in such a manner as to produce a volumetric flow in the respective vapor hose slightly greater than that in the respective fuel delivery hose.

8. A dispensing system for dispensing volatile liquids such as hydrocarbon fuel for vehicles into a tank having a filler neck while collecting the vapors to reduce atmospheric pollution comprising:

a liquid delivery means including a liquid delivery hose including a hand-held nozzle for insertion in the opening of the tank;

metering means for the liquid delivery hose for providing pulses occurring at a repetition rate corresponding to the volumetric flow of liquid through said liquid delivery hose;

a vapor suction hose including a vapor intake connected to said hand-held nozzle for insertion in the opening of the tank without sealing with the tank;

a motor driven vapor suction pump, said suction pump producing a volumetric flow through a suction hose having an open valve corresponding to a signal applied to said motor; and a digital processing means responsive to the pulses from the metering means for producing the signal applied to said motor to cause said suction pump to have a volumetric flow greater than the volumetric flow through the liquid delivery hose.

9. A dispensing system for dispensing volatile liquids such as hydrocarbon fluids for vehicles while collecting the vapors to reduce atmospheric pollution comprising:

a liquid dispensing means including:

a hand-held nozzle and liquid valve means disposed at the end of a flexible hose for flowing liquid into the fuel tank of a vehicle under the control of an operator, vapor collection means including:

a vapor intake means positioned to be closely adjacent, but not sealed with, the fuel tank for collecting vapors displaced from the fuel tank as the liquid is flowed through the liquid valve into the tank at a variable, controlled rate, vapor suction means including a vapor pump driven by an electrical motor and coupled to draw vapors from the vapor intake associated with the liquid dispensing means, and delivering the vapor to vapor storage means, flow meter means for producing a first electrical signal representative of the rate of flow of liquid being dispensed from the nozzle; and digital processing means for receiving the first electrical signals and operating the vapor collection means at a controlled rate to pump vapors through the vapor intake at volumetric rate having a predetermined relationship to the volumetric rate at which liquid is being flowed from the nozzle whereby substantially all fuel vapor will be delivered to the vapor storage means.

10. The method of dispensing a liquid fuel from a corresponding liquid storage tank at a single point of sale through a corresponding hand-held nozzle having a normally closed fuel valve into a fuel tank having a filler neck which comprises:

on demand from a customer's operation of the fuel valve of a selected nozzle, pumping fuel from the corresponding storage tank through a meter to the customer's fuel tank having a filler neck while producing an electrical signal representative of the volume flow rate of the fuel, digitally processing the electrical signal and operating an electrically driven vapor pump connected to allow the nozzle, which is positioned closely adjacent to, but not sealed with, the fuel tank, to collect vapors displaced from the fuel tank by a vacuum intake disposed adjacent but not sealed with the filler neck of the customer's fuel tank at a vapor volume flow rate having a predetermined relationship to the fuel flow rate represented by the electrical signal, and discharging the pumped vapors to a storage tank.

11. The method claim 10 further comprising digitally processing the electrical signal to calculate the total volume of the selected fuel being dispensed to the customer's tank and the total cost, and displaying the volume and cost information to the customer at the point of sale.

* * * * *

UNITED STATES PATENT AND TRADEMARK OFFICE

CERTIFICATE OF CORRECTION

PATENT NO. : 6,899,149 B1
DATED : May 31, 2005
INVENTOR(S) : Kenneth L. Pope

It is certified that error appears in the above-identified patent and that said Letters Patent is hereby corrected as shown below:

Title page,
Item [12], should read -- Kenneth L. Pope -- only.
Item [75], Inventor, should read -- Kenneth L. Pope, Walkertown, NC (US) -- only.

Signed and Sealed this

Ninth Day of August, 2005

JON W. DUDAS
*Director of the United States Patent and Trademark Office*